US006471173B1

(12) United States Patent
Tseng

(10) Patent No.: US 6,471,173 B1
(45) Date of Patent: Oct. 29, 2002

(54) FOLDABLE FRAME SUPPORT DEVICE FOR SUPPORTING A TOP PLATE USED FOR FURNITURE

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/053,609

(22) Filed: Jan. 22, 2002

(51) Int. Cl.[7] ..... F16M 11/32
(52) U.S. Cl. ..... 248/439; 248/166; 108/132
(58) Field of Search ..... 248/150, 166, 248/440, 439, 188.6, 188.91, 688, 691, 188, 436; 108/132, 131, 129

(56) References Cited

U.S. PATENT DOCUMENTS 1,593,975 A * 7/1926 Karstens ..... 108/132
2,969,249 A * 1/1961 Fox ..... 108/131
4,611,823 A * 9/1986 Haas ..... 108/119
4,821,650 A * 4/1989 Simpson ..... 108/117
5,404,962 A * 4/1995 Carter ..... 182/153
5,606,922 A * 3/1997 Adams et al. ..... 108/129
5,636,578 A * 6/1997 Rizzi ..... 108/129
5,638,761 A * 6/1997 Berkowitz et al. ..... 108/132
5,845,589 A * 12/1998 Pfister ..... 108/132
5,865,128 A * 2/1999 Tarnay ..... 108/131
5,913,272 A * 6/1999 Gutgsell et al. ..... 108/132
6,112,674 A * 9/2000 Stanford ..... 108/129

* cited by examiner

*Primary Examiner*—Anita King
*Assistant Examiner*—Tan Le
(74) *Attorney, Agent, or Firm*—Ladas & Parry

(57) ABSTRACT

A foldable frame support device for supporting a top plate used for furniture, includes two support braces disposed to prop releasably and respectively two support legs in a straddling position. Each support brace includes a spring-biased locking lever with a locking end to snap an anchoring end of a respective strut member. The strut member has a pivot end connected pivotally to a respective support leg so as to be swingable to permit placement of the support leg in a folded position upon actuating the locking lever to release the anchoring end of the strut member.

7 Claims, 7 Drawing Sheets

FOLDABLE FRAME SUPPORT DEVICE FOR SUPPORTING A TOP PLATE USED FOR FURNITURE

BACKGROUND OF THE INVENTION

1. Field of the Invention

This invention relates to a foldable frame support device for supporting a top plate used for furniture, such as a table, a chair, or the like, more particularly to a foldable frame support device which has support braces to prop releasably two support legs in a straddling position.

2. Description of the Related Art

Referring to FIG. 1, a conventional foldable table 1 is shown to include a pair of support legs 16, a pair of side rods 15 which are connected pivotally to upper pivot shafts of the support legs 16 such that the support legs 16 are turnable relative to the side rods 15 between folded and straddling positions, a pair of cross shafts 131 which are connected to the side rods 15, a pair of foldable support braces 11, and a table top 10 which is mounted on the side rods 15.

Each support brace 11 includes a rod connecting portion 111 and a leg connecting portion 112 which are connected pivotally to each other at proximate ends thereof about a pivot pin 113, and which are connected pivotally and respectively to the corresponding cross rod 131 and the corresponding support leg 16 at distal ends thereof. Thus, the portions 111,112 are generally aligned with each other in an extended state of the support brace 11 to prop the support legs 16 in the straddling position.

However, when an external force is applied to the pivot pin 113, such as that due to upward movement of the leg of a person sitting at the sides of the foldable table 1, the rod and leg connecting portions 111,112 are liable to be folded toward each other, thereby resulting in undesired folding of the table 1.

SUMMARY OF THE INVENTION

The object of the present invention is to provide a foldable frame support device which can be maintained in a straddling state and prevented from undesired folding.

According to this invention, the foldable frame support device includes a pair of support legs spaced apart from each other in a longitudinal direction. Each support leg has a top end with a pivot shaft which extends in a transverse direction transverse to the longitudinal direction and which has front and rear end segments opposite to each other in the transverse direction. Each support leg further has a bottom end adapted to be placed on a ground surface, and an intermediate portion disposed between the top and bottom ends. A pair of side rods extend in the longitudinal direction and are spaced apart from each other in the transverse direction. Each side rod has two opposite ends which are connected pivotally and respectively to a respective pair of the end segments of the pivot shafts about first and second axes parallel to each other. The support legs are turnable relative to the side rods between a folded position, where the bottom ends of the support legs are closer to the side rods, and a straddling position, where the bottom ends of the support legs are remote from the side rods. A pair of support braces are disposed to prop releasably and respectively the support legs in the straddling position. Each support brace includes a cross shaft which extends in the transverse direction and which is disposed inboard to the pivot shaft. The cross shaft has two connected ends connected respectively to the side rods, and an intermediate segment disposed therebetween. An anchored member has an upper secured portion secured on the intermediate segment of the cross shaft, and a lower anchored portion extending downwardly from the upper secured portion to terminate at a lower wall. The lower wall defines an anchored concavity extending toward the upper secured portion. A strut member has a pivot end pivotally connected to the intermediate portion of the support leg, and an anchoring end which is swingable relative to the intermediate portion between an engaged position, where the anchoring end engages the anchored concavity so as to prop the support leg in the straddling position, and a disengaged position, where the anchoring end disengages from the anchored concavity so as to permit placement of the support leg in the folded position. A locking lever extends in the longitudinal direction, and has a fulcrum which is connected pivotally to the anchored member about a pivot axis in the transverse direction, a locking end which is disposed at one side of the fulcrum and which extends in the anchoring concavity to snap the anchoring end when the anchoring end is in the engaged position, and an actuated end which is disposed at the other side of the fulcrum and which is turnable about the pivot axis between a first position, where the locking end snaps the anchoring end, and a second. position, where the locking end releases the anchoring end. A biasing member is disposed to bias the actuated end to the first position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
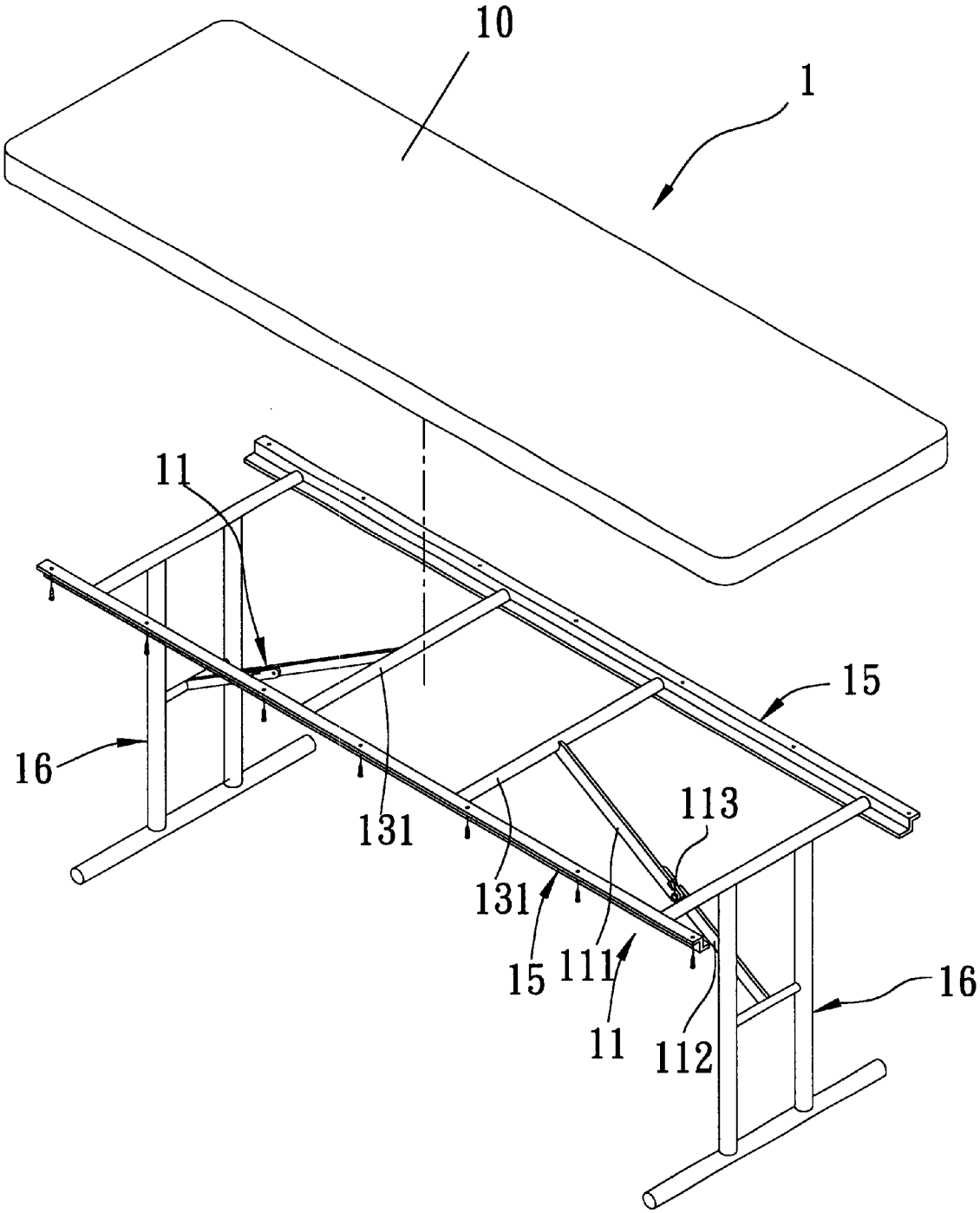
FIG. 1 PRIOR ART
FIG. 1 is a partly exploded perspective view of a conventional foldable table in a straddling state.

Before the present invention is described in greater detail, it should be noted that same reference numerals have been used to denote like elements throughout the specification.

Figure 2:
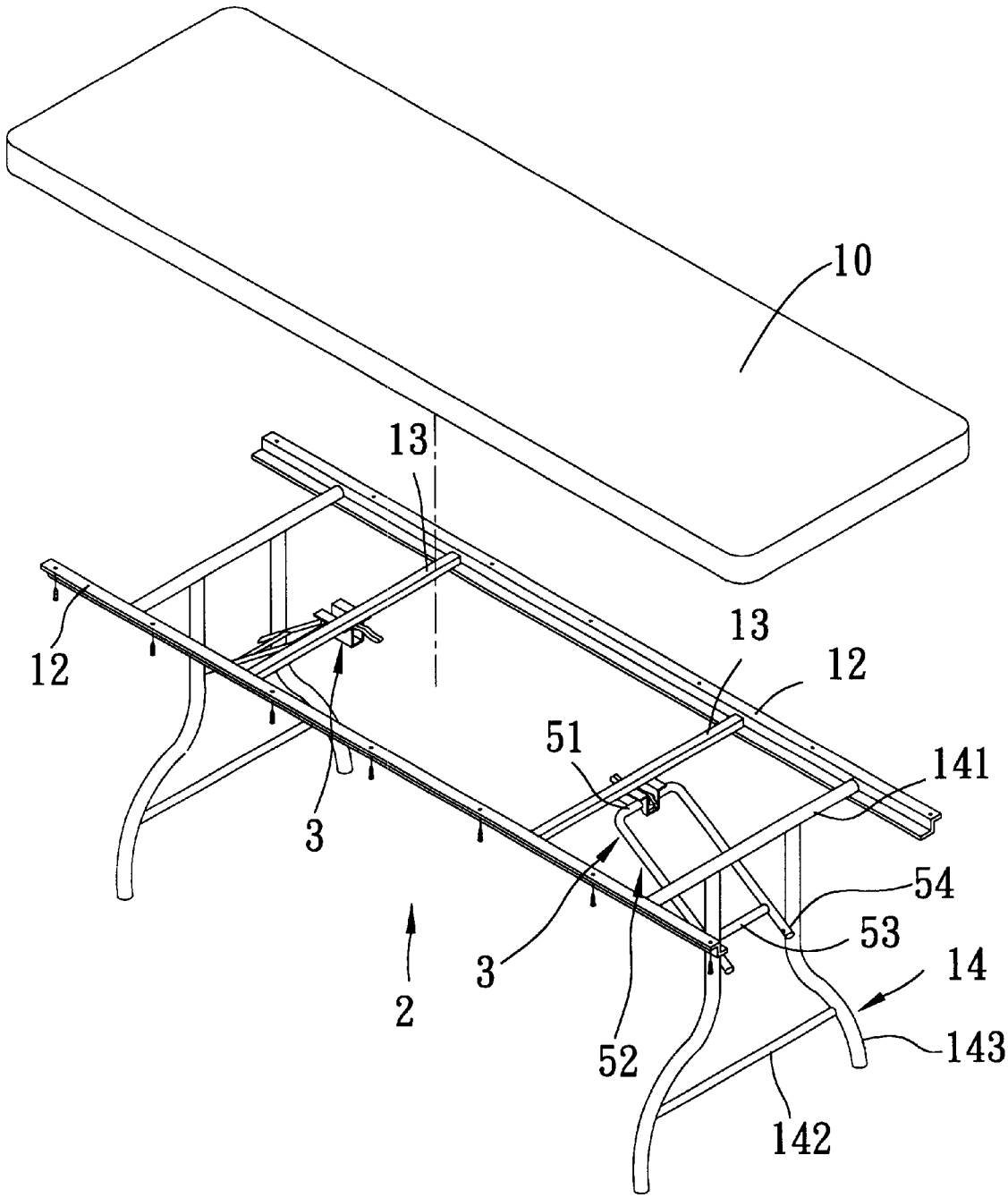
FIG. 2 is a perspective view of a first preferred embodiment of a foldable frame support device according to this invention in a straddling state.

Referring to FIG. 2, the first preferred embodiment of the foldable frame support device 2 according to the present invention is shown to be adapted to support a top plate, such as a table top 10, and comprises a pair of support legs 14, a pair of side rods 12, and a pair of support braces 3. The table top 10 is adapted to be mounted on the side rods 12.

The support legs 14 are spaced apart from each other in a longitudinal direction. Each support leg 14 has a top end formed with a pivot shaft 141 which extends in a transverse direction transverse to the longitudinal direction and which has front and rear end segments opposite to each other in the transverse direction. Each support leg 14 further has a bottom end 143 which is adapted to be placed on a ground surface, and an intermediate portion which is disposed between the pivot shaft 141 and the bottom end 143. A tubular connecting portion 142 extends in the transverse direction and is disposed on the intermediate portion and adjacent to the bottom end 143.

The side rods 12 extend in the longitudinal direction and are spaced apart from each other in the transverse direction. Each side rod 12 has two opposite ends which are connected pivotally and respectively to a respective pair of the end segments of the pivot shafts 141 about first and second axes that extend in the transverse direction. Thus, the support legs 14 are turnable relative to the side rods 12 about the axes between a folded position, where the bottom ends 143 of the support legs 14 are closer to the side rods, 12, and a straddling position, where the bottom ends 143 are remote from the side rods 12.

The support braces 3 are disposed to prop releasably and respectively the support legs 14 in the straddling position. Each support brace 3 includes a cross shaft 13 which extends in the transverse direction and which is disposed inboard to the pivot shaft 141 of the respective support leg 14 in the longitudinal direction. The cross shaft 13 has two connected ends which are connected respectively to the side rods 12, and an intermediate segment which is disposed between the connected ends.

Figure 3:
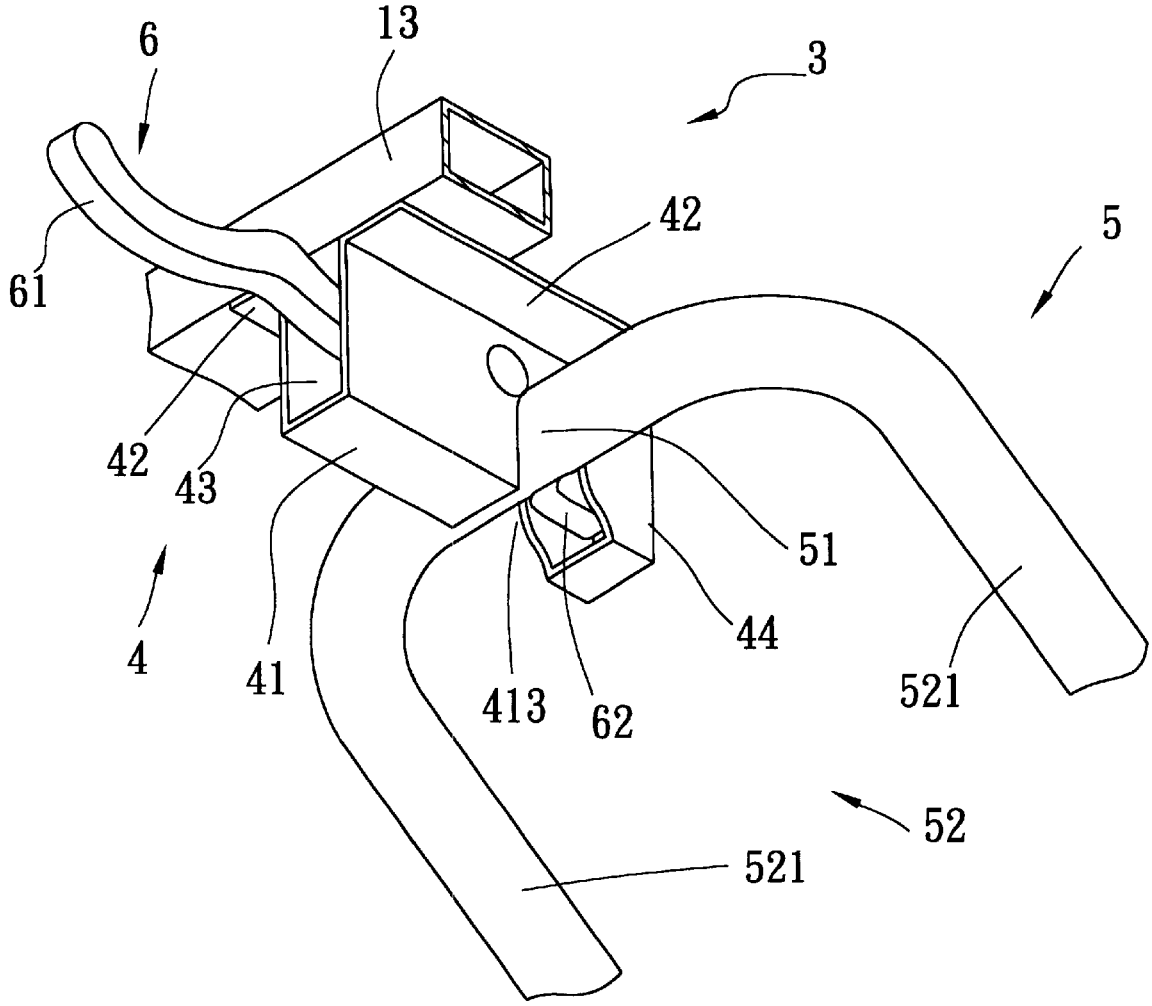
FIG. 3 is a perspective view of a portion of the first embodiment.
Figure 4:
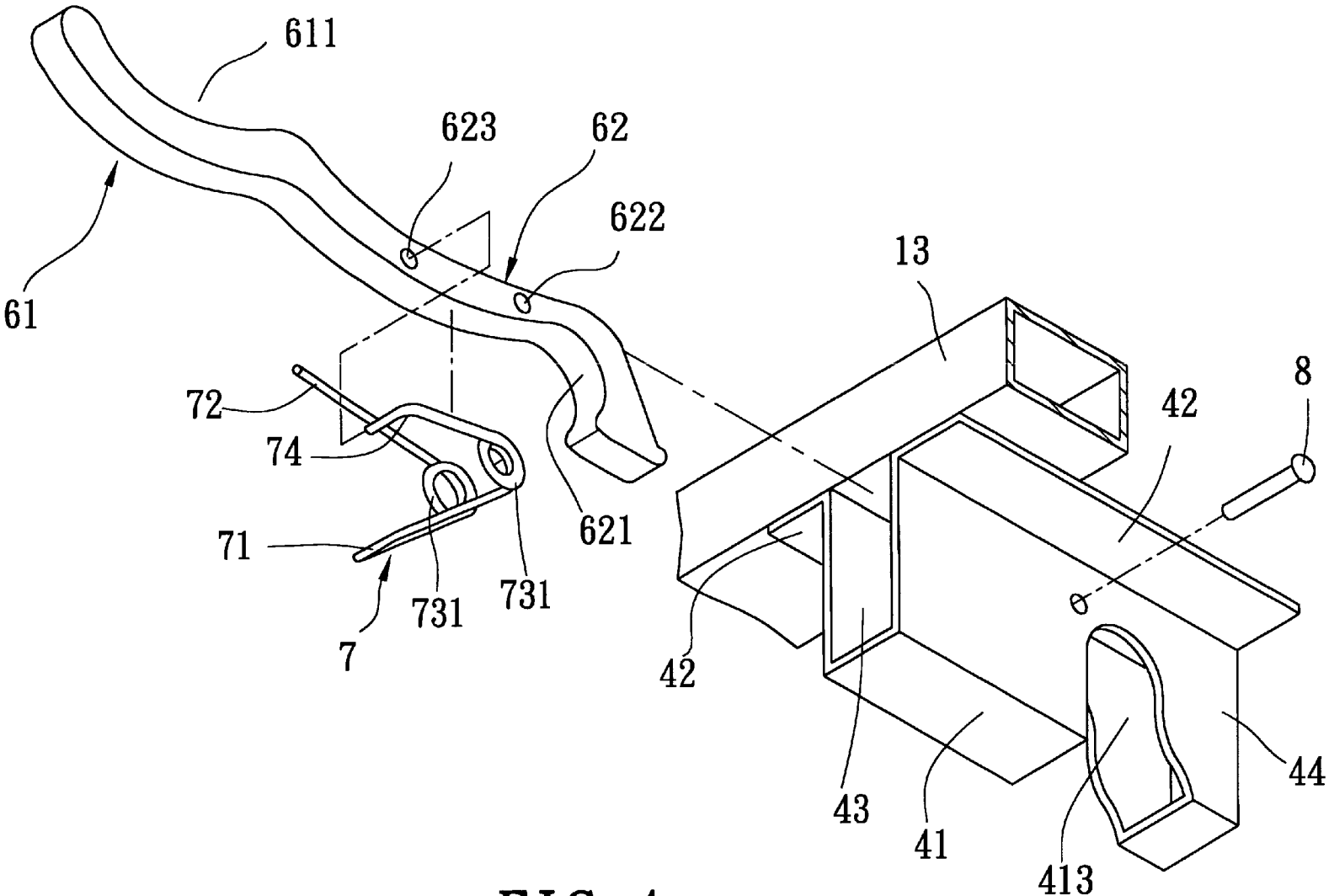
FIG. 4 is an exploded perspective view of the portion shown in FIG. 3.

With reference to FIGS. 3 and 4, an anchored member 4 has an upper secured portion formed with two secured walls 42 which are secured on the intermediate segment of the cross shaft 13, and a lower anchored portion which extends downwardly from the upper secured portion and away from the cross shaft 13. The lower anchored portion includes two side walls 44 which extend downwardly and respectively from the secured walls 42 to join with a lower wall 41 to confine an accommodation space 43. The lower wall 42 defines an anchored concavity 413 which extends upwardly and in the transverse direction to communicate with the side walls 44.

A strut member 5 has a pivot end 54 which is pivotally connected to the intermediate portion of the respective support leg 14, and a U-shaped anchoring end 52 which is disposed opposite to the pivot end 54 and which includes two connecting portions 521 extending from the pivot end 54 to terminate at a grip portion 51 that is elongated in the transverse direction. Thus, the anchoring end 52 is swingable relative to the intermediate portion of the support leg 14 about a third axis in the transverse direction between an engaged position, where the grip portion 51 is inserted into the anchored concavity 413 with two ends thereof extending outwardly and respectively of the side walls 44 so as to prop the respective support leg 14 in the straddling position, and a disengaged position, where the grip portion 51 disengages from the anchored concavity 413 so as to permit placement of the respective support leg 14 in the folded position. In addition, a tubular resting portion 53 extends in the transverse direction and is disposed adjacent to the pivot end 54.

Figure 5:
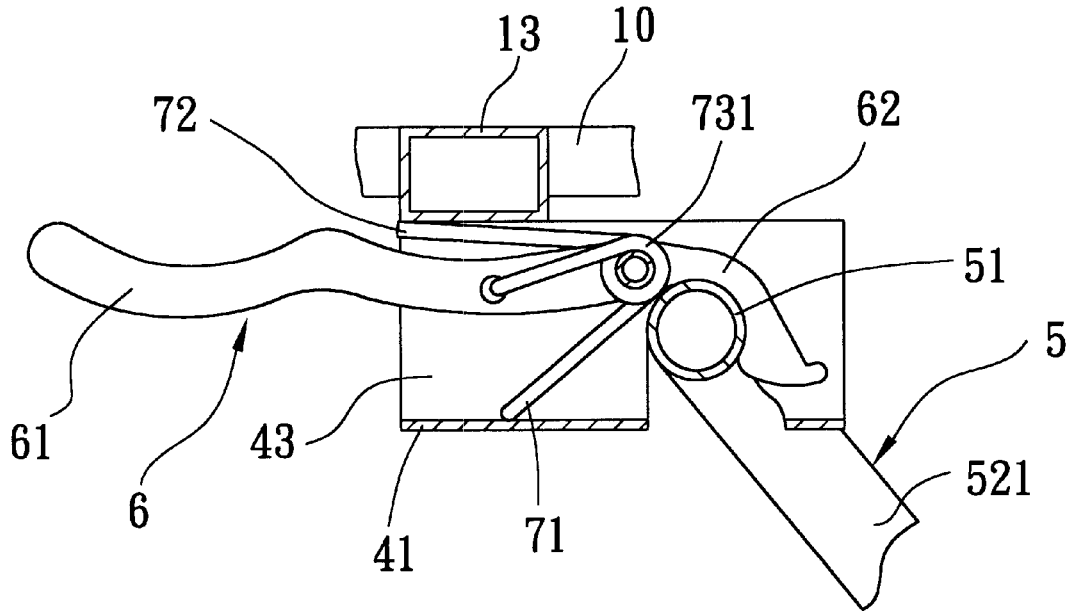
FIG. 5 is a partly sectional side view of the portion shown in FIG. 3.
Figure 6:
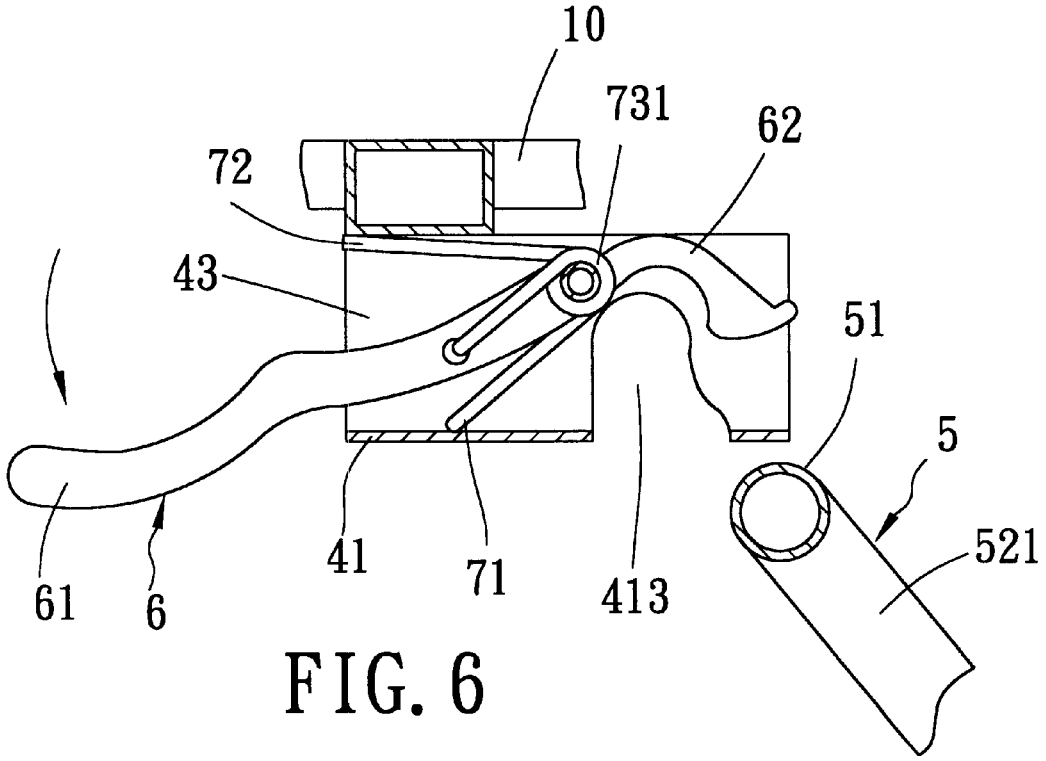
FIG. 6 is a partly sectional side view of the portion shown in FIG. 3 when actuated.

Referring to FIGS. 4 and 5, a locking lever 6 extends in the longitudinal direction, and has a pivot hole 622 formed as a fulcrum. A pivot pin 8 passes through one of the side walls 44 and the pivot hole 622 to connect pivotally the locking lever 6 to the anchored member 4 about a pivot axis in the transverse direction. A locking end 62 is disposed at one side of the pivot hole 622 and is inserted into the accommodation space 43 to reach the anchoring concavity 413. Thus, when the anchoring end 52 is in the engaged position, as shown in FIG. 5, the locking end 62 has a curved snap wall 621 which snaps the grip portion 51. An actuated end 61 is disposed at the other side of the pivot hole 622 and is turnable about the pivot axis between a first position, where the locking end 62 snaps the grip portion 51 as described previously, and a second position, where the locking end 62 is lifted to release the grip portion 51, as shown in FIG. 6. In addition, the actuated end 61 is curved so as to be spaced apart from the table top 10 by a space 611 for facilitating operation.

A biasing member 7 is received in the accommodation space 43 to bias the actuated end 61, which extends above the lower wall 41, to the first position. In this embodiment, the biasing member 7 includes a lower abutting segment 71 which abuts against the lower wall 41, an upper engaging segment 74 which is disposed opposite to the lower abutting segment 71 in an upright direction transverse to both the longitudinal and transverse directions and which passes through and which is secured in a hole 623 in the locking lever 6, an upper abutting segment 72 which is disposed opposite to the lower abutting segment 71 in the upright direction to abut against the cross shaft 13 so as to secure the biasing member 7 in the accommodation space 43, and two coiled portions 731 which are disposed between the lower abutting segment 71 and the upper engaging segment 74 and between the lower abutting segment 71 and the upper abutting segment 72 so as to provide an upward biasing action to move the actuated end 61 away from the lower wall 41.

By means of the locking end 62 which snaps the grip portion 51 of the anchoring end 52, the strut member 5 can prop the respective support leg 14 in the straddling position and can prevent undesired folding of the support leg 14.

Figure 7:
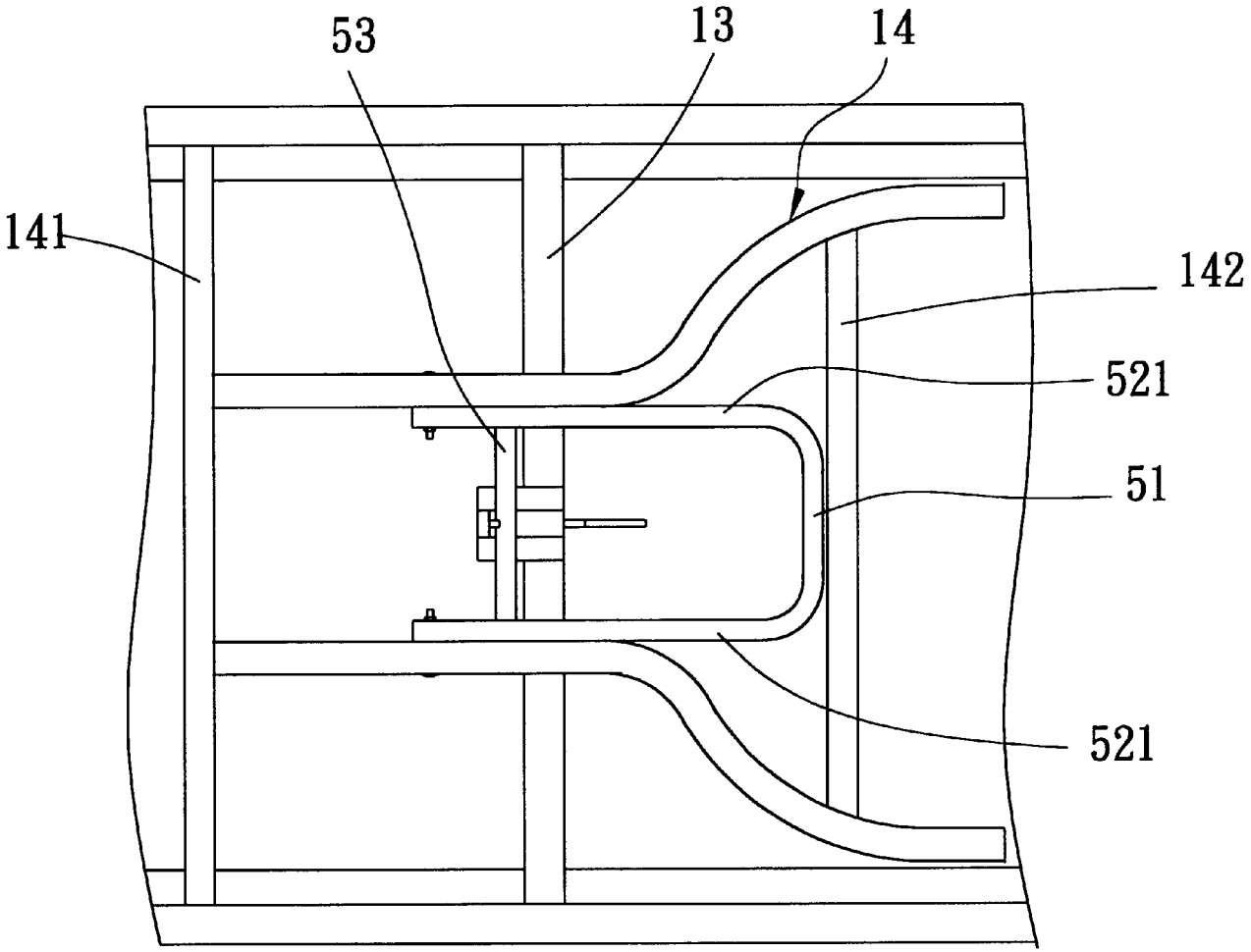
FIG. 7 is a bottom view of a portion of the first embodiment when folded.

When it is desired to fold the frame support device 2, as shown in FIGS. 2, 6 and 7, the actuated end 61 is moved downwards to the second position against the biasing action of the biasing member 7 to permit the locking end 62 to release the grip portion 51. In this state, the anchoring end 52 of the strut member 5 can disengage from the anchored concavity 413 and swing towards the support leg 14 such that the grip portion 51 abuts against the connecting portion 142 of the support leg 14. Then, the support leg 14 can be turned in the folded position such that the resting portion 53 of the strut member 5 is inserted into the anchored concavity 413 and is snapped by the locking end 62. As such, the folded frame support device 2 can be conveniently transported and moved.

Figure 8:
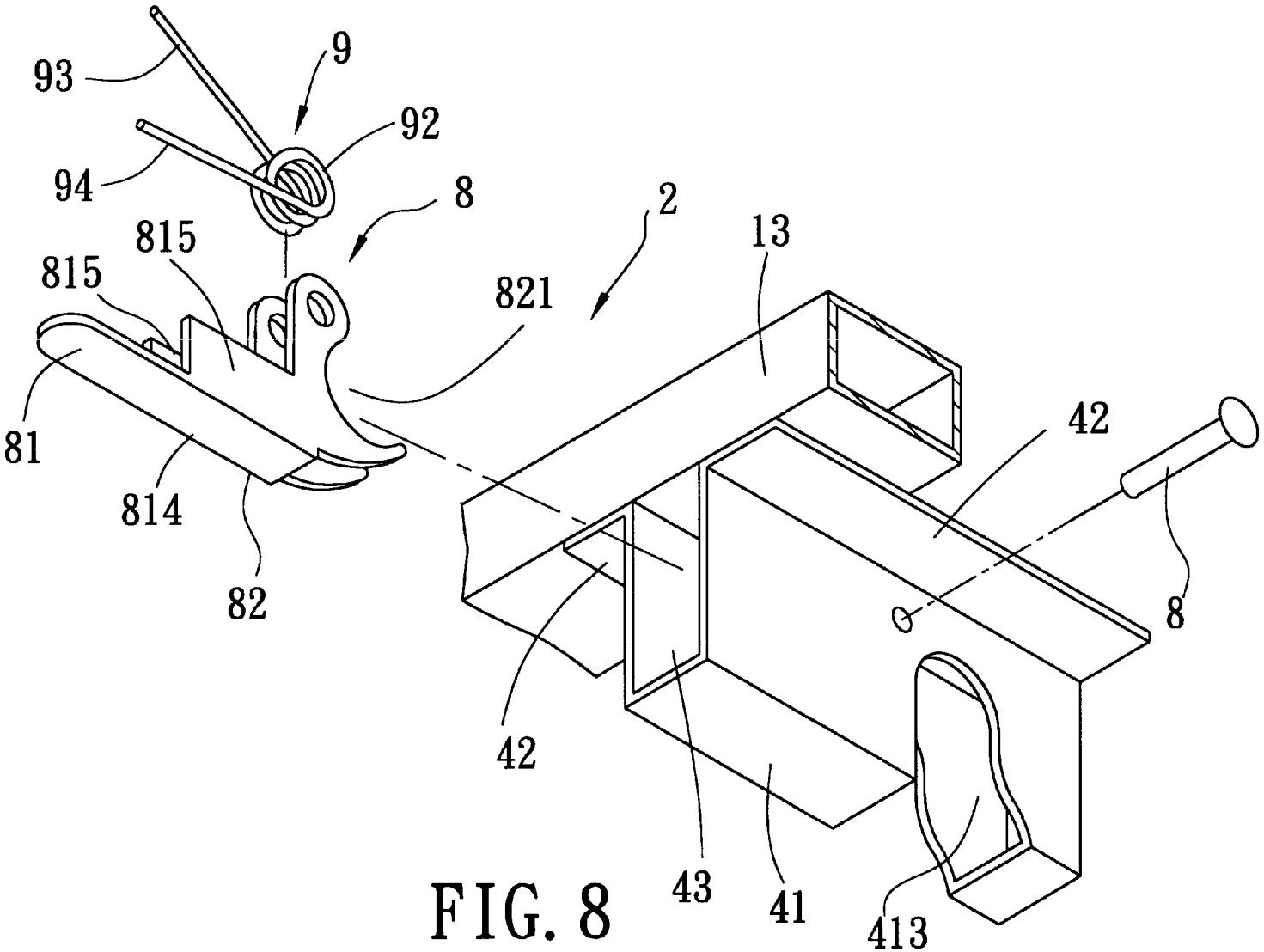
FIG. 8 is an exploded perspective view of a portion of a second preferred embodiment according to this invention.

Referring to FIG. 8, the second preferred embodiment of the foldable frame support device according to this invention is shown to be different from the first embodiment in that a locking lever 8 includes a plate-shaped actuated end 81 and a locking end 82 disposed opposite to each other in the longitudinal direction. The actuated end 81 has a bottom wall 814, and two side walls 815 extending upwardly from two sides of the bottom wall 814. The locking end 82 confines a locking recess 821, and is inserted into the accommodation space 43 of the anchored member 4 such that the locking recess 821 corresponds with the anchored concavity 413. In addition, a biasing member 9 is in the form of a torsion spring, and includes upper and lower abutting segments 93,94 which abut respectively against the intermediate segment of the cross shaft 13 and the bottom wall 814, and a coiled portion 92 which is disposed between the upper and lower abutting segments 93,94 so as to provide a downward biasing action to move the actuated end 81 toward the lower wall 41. Thus, the actuated end 81 is moved upwards against the biasing action of the biasing member 9 to permit the locking end 82 to release the grip portion 51 engaged in the anchored concavity 413.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A foldable frame support device for supporting a top plate used for furniture, said device comprising:

a pair of support legs spaced apart from each other in a longitudinal direction, each of said support legs having a top end formed with a pivot shaft which extends in a transverse direction transverse to the longitudinal direction and which has front and rear end segments opposite to each other in the transverse direction, each of said support legs further. having a bottom end adapted to be placed on a ground surface, and an intermediate portion disposed between said top and bottom ends;

a pair of side rods extending in the longitudinal direction and spaced apart from each other in the transverse direction, each of said side rods having two opposite ends connected pivotally and respectively to a respective pair of said front and rear end segments of said pivot shafts about first and second axes which are parallel to each other, such that said support legs are turnable relative to said side rods about the first and second axes between a folded position, where said bottom ends of said support legs are closer to said side rods, and a straddling position, where said bottom ends of said support legs are remote from said side rods; and a pair of support braces disposed to prop releasably and respectively said support legs in the straddling position, each of said support braces including a cross shaft extending.in the transverse direction and disposed inboard to said pivot shaft of the respective one of said support legs in the longitudinal direction, said cross shaft having two connected ends connected respectively to said side rods, and an intermediate segment disposed therebetween, an anchored member having an upper secured portion secured on said intermediate segment of said cross shaft, and a lower anchored portion extending downwardly from said upper secured portion and away from said cross shaft to terminate at a lower wall, said lower wall defining an anchored concavity which extends toward said upper secured portion, a strut member having a pivot end pivotally connected to said intermediate portion of a respective one of said support legs, and an anchoring end disposed opposite to said pivot end and swingable relative to said intermediate portion about a third axis parallel to the first axis between an engaged position, where said anchoring end engages said anchored concavity so as to prop the respective one of said support legs in the straddling position, and a disengaged position, where said anchoring end disengages from said anchored concavity so as to permit placement of the respective one of said support legs in the folded position, a locking lever extending in the longitudinal direction, and having a fulcrum connected pivotally to said anchored member about a pivot axis in the transverse direction, a locking end disposed at one side of said fulcrum and extending in said anchoring concavity to snap said anchoring end when said anchoring end is in the engaged position, and an actuated end disposed at the other side of said fulcrum and turnable about the pivot axis between a first position, where said locking end snaps said anchoring end, and a second position, where said locking end releases said anchoring end, and a biasing member disposed to bias said actuated end to the first position.

2. The foldable frame support device of claim 1, wherein said lower anchored portion of said anchored member includes two side walls spaced apart from each other in the transverse direction and extending to join with said lower wall, said anchored concavity extending in the transverse direction to communicate with said side walls, said anchoring end of said strut member including a grip portion that is elongated in the transverse direction to terminate at two ends and that is dimensioned such that said grip portion is insertable into said anchored concavity with said two ends extending outwardly and respectively of said side walls.

3. The foldable frame support device of claim 2, wherein said strut member of each of said support braces further includes a resting portion elongated in the transverse direction and disposed adjacent to said pivot end, said resting portion being located such that said resting portion engages said anchored concavity and is snapped by said locking end when said anchoring end is in the disengaged position and when said support legs are turned to the folded position.

4. The foldable frame support device of claim 3, wherein each of said support legs further has a connecting portion elongated in the transverse direction and disposed on said intermediate portion and adjacent to said bottom end, said connecting portion being located such that said grip portion abuts against said connecting portion when said anchoring end is in the disengaged position and when said support legs are turned to the folded position.

5. The foldable frame support device of claim 1, wherein said actuated end extends above said lower wall, and said biasing member includes a lower abutting segment abutting against said lower wall, an upper engaging segment disposed opposite to said lower abutting segment in an upright direction transverse to both the longitudinal and transverse directions and engaging said actuated end, and a coiled portion disposed between said lower abutting segment and said upper engaging segment so as to provide an upward biasing action to move said actuated end away from said lower wall.

6. The foldable frame support device of claim 5, wherein said biasing member further includes an upper abutting segment disposed opposite to said lower abutting segment in the upright direction and abutting against said cross shaft so as to secure said biasing member to said anchored member.

7. The foldable frame support device of claim 1, wherein said actuated end extends above said lower wall, and said biasing member includes upper and lower abutting segments respectively abutting against said intermediate segment of said cross shaft and said actuated end, and a coiled portion disposed between said upper and lower abutting segments so as to provide a downward biasing action to move said actuated end toward said lower wall.

* * * * *